United States Patent [19]

Capaul et al.

[11] 4,428,454

[45] Jan. 31, 1984

[54] ACOUSTICAL PANEL CONSTRUCTION

[76] Inventors: Raymond W. Capaul, Rte #3, Wildwood Dr. Box 643, Aurora, Ill. 60504; Barry D. Capaul, 6010 Oakwood, Apt. 4D, Lisle, Ill. 60532

[21] Appl. No.: 414,298

[22] Filed: Sep. 2, 1982

Related U.S. Application Data

[63] Continuation-in-part of Ser. No. 305,286, Sep. 24, 1981.

[51] Int. Cl.[3] ..... E04B 1/82

[52] U.S. Cl. ..... 181/290; 181/291; 181/295; 52/144; 52/484

[58] Field of Search ..... 181/286-291, 181/296, 295; 52/144, 145, 484, 772

[56] References Cited

U.S. PATENT DOCUMENTS

| | | | |
|---|---|---|---|
| 2,802,764 | 8/1957 | Slayter et al. | 181/291 |
| 3,183,996 | 5/1965 | Capaul | 181/291 |
| 3,265,154 | 8/1966 | March | 181/290 |
| 3,422,920 | 1/1969 | Greason et al. | 181/291 |
| 3,581,453 | 6/1971 | Jones et al. | 52/144 X |
| 3,782,495 | 1/1974 | Nassoy | 181/291 X |
| 4,040,213 | 8/1977 | Capaul | 52/145 |
| 4,248,325 | 2/1981 | Georgopoulos | 181/290 X |

*Primary Examiner*—Benjamin R. Fuller
*Attorney, Agent, or Firm*—Wallenstein, Wagner, Hattis, Strampel & Aubel

[57] ABSTRACT

An acoustical panel construction which, in its preferred form, comprises a preformed body portion or shell, the outwardly extending edges of which are formed of thin, but dense, acoustical material. The density, thickness and configuration of the edges provides the necessary rigidity and structural strength to enable a panel formed from the body portion or shell to be properly edge supported on, and conform to, a grid system. The body portion or shell advantageously is formed with a central area of acoustical material which is thicker, but less dense than the edge areas, to enhance the acoustical properties of the finished panel. The body portion or shell is adapted to receive a sheet or layer of an acoustical material having a preselected density and thickness such that the finished panel will be able to meet the sound absorption and resistance to fire, among other demands, of the environment in which the panel is installed. The sheet or layer of acoustical material desirably is bonded to the acoustical material comprising the central area of the shell, and advantageously is provided with a metallic film or foil backing. The exposed surface of the shell has a facing material adhered thereto which imparts both decorative and added functional features to the finished panel. Septa may be incorporated in the panel construction to improve the acoustical properties of the panel, and to inhibit the passage of dirt-laden air through the panel.

13 Claims, 10 Drawing Figures

ACOUSTICAL PANEL CONSTRUCTION

This application is a continuation-in-part application of Ser. No. 305,286, filed Sept. 24, 1981.

The present invention relates to an acoustical panel construction, and, in particular, to an acoustical panel construction which enables the fabrication of a finished panel capable of meeting the performance and decorative demands of substantially any environment in which the panel is installed.

The use of acoustical panels having high sound absorption properties and resistance to fire, as well as other functional features, has been greatly expanded in modern day construction, especially in office-type and commercial buildings. Exemplary of acoustical panels which have attained widespread recognition and acceptance among architects and builders are the panels disclosed in U.S. Pat. Nos. 3,183,996 and 4,040,213. Panels of this type are constructed in various sizes, the most popular sizes being 2'×2', 2'×4', 4'×4' and 5'×5'. The thickness of the panels is generally from about $\frac{5}{8}$ inch to about $1\frac{1}{2}$ inches. Mineral fibers and glass fibers are, in the main, used as sound deadening materials in the construction of such panels. Decorative facing materials are provided for the exposed surfaces of the panels, and, in the case of the panel disclosed in the aforementioned U.S. Pat. No. 3,183,996, a metallic film is used as a backing to more effectively dissipate sound enery, and, among other things, to reduce "breathing" through the panel. The sound deadening or absorbing material employed in the manufacture of such panels has a uniform density and thickness, and the finished panels are formed by passing the sound absorbing material, together with the other components which go to make up the completed panel, through an oven where the bonding of the components of the panel is carried out. The configuration, as well as the functional properties of the finished panel are fixed when the panel exits from the oven. This practice, while producing a high quality panel, does not lend itself to the fabrication of acoustical panels capable of meeting the special needs of an environment in which the panels are to be installed.

In accordance with the present invention, an acoustical panel construction has been evolved which permits unique flexiblility and versatility in the fabrication of an acoustical panel. The panel construction of this invention can be customized or tailor-made to meet the performance demands, from the standpoint of sound absorption, fire resistance, light reflectance, heat barrier, decor, ease of installation, and overall appearance, of substantially any environment in which the panel is to be installed. Wholly apart from the unique customizing features of the invention, the panel construction of this invention has sound absorption properties which exceed those of conventional acoustical panels. Thus, for example, panels constructed by the practice of the present invention have noise reduction coefficients upwards of 1.05, whereas high quality conventional acoustical panels have coefficients ranging from 0.50 to 0.95. What is more, these results are attainable at a cost comparable to, and in certain cases, lower than that incurred in the manufacture of standard acoustical panels in that the panel construction of this invention incorporates more economical design features, and enables the utilization of more economical materials.

The panel construction of the present invention, in brief, comprises a preformed body portion or shell which establishes the configuration, rigidity and the dimensions, except for the total thickness, of an acoustical panel to be formed therefrom. The shell includes a central or exposed area formed of an acoustical material having a predetermined density and thickness. Joined to the central area of the shell are outwardly extending edges by means of which the finished panel is supported on a grid system. The edges are contoured to enable them to conform exactly to a grid system thereby substantially reducing both any sound transmission between the edges of the panel and the grid system, and the double-line effect between the panel and the grid system which characterizes conventional acoustical panel installations, and which architects deem objectionable. The edges of the shell are formed of an acoustical material, the density and thickness of which is such as to impart the necessary rigidity and structural strength to the edges to enable them to support a panel formed from the shell on a grid system without any concomitant sagging or warping of the finished panel. The exposed, or outer, surface, including the edges, of the shell advantageously is provided with a facing of a desired color to compliment the decor of the environment in which a panel formed from the shell is to be installed. Apart from its decorative function, the facing adds to the rigidity, dimensional stability and structural strength of the shell, and can serve to effectively reflect, or absorb, light, and can enhance, or augment, the sound absorption properties of the panel.

The central area of the shell is adapted to receive a pre-cut, or pre-formed, sheet or batt of an acoustical material, the density and thickness of which is preselected to meet the specific performance requirements of an environment in which a panel is to be installed. The sheet or batt of acoustical material desirably is provided with a backing, especially a metallic backing such as a metal foil which, among other things, imparts enhanced sound transmission properties to the finished panel, while eliminating breathing and improving the thermal properties of the panel. In accordance with one aspect of the invention, the edges of the panels can be sealed and the metal foil can be wrapped around the edges to completely seal the panels thereby to prevent dust and loose fibers from entering the environment. This form of the panel construction has special utility in rooms where computer, or other sensitive electronic equipment, is kept.

The preformed body portion or shell of the panel construction of the present invention can be fabricated in any size desired and conveniently stored for future use. The ability to form a finished panel from the preformed shell which will meet the performance demands of substantially any environment in which the panel is installed also has important economic advantages both from the standpoint of reduced material costs, and simpler, less expensive manufacturing procedures in that molds instead of high temperature operated ovens can be used to form the preformed shell and the finished panel.

The foregoing, and other advantages and features of the panel construction of this invention will become apparent from the description to follow taken in conjunction with the accompanying drawings wherein.

Figure 3:
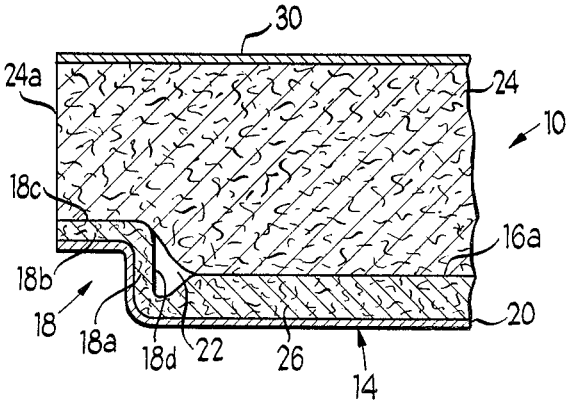
FIG. 3 is a fragmentary, enlarged sectional view of an embodiment of the panel construction of the present invention.
Figure 4:
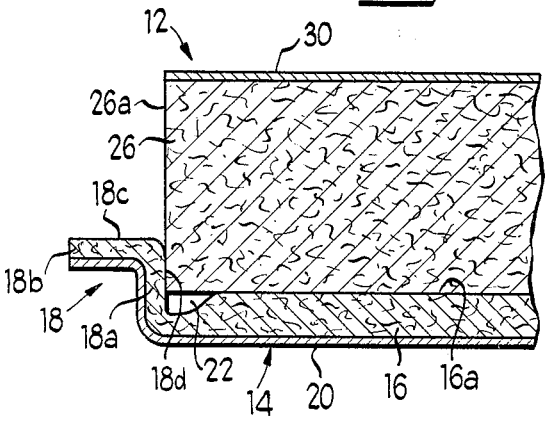
FIG. 4 is an enlarged fragmentary sectional view of another embodiment of the panel construction of the present invention.

Referring, now, in greater detail to FIGS. 3 and 4 of the drawings, the two embodiments of the acoustical panel construction of this invention illustrated, and designated generally by reference numerals 10 and 12, respectively, each comprise a preformed, rectangularly shaped body portion or shell 14. The shell 14 comprises a central or exposed area 16 formed of an acoustical material having a predetermined density and thickness. The area 16, as shown, is joined to, and preferably is integral with, stepped edges 18, also formed of an acoustical material or predetermined density and thickness, and desirably located on all four sides of the shell 14. Each edge 18 of the shell 14 includes an inwardly extending section 18*a* joined at substantially a right angle to an outwardly extending section 18*b*.

The preformed shell 14 can be fabricated of various acoustical, or sound absorbing, and fire resistant materials, including mineral wools such as slag or rock wool, glass fibers, as well as organic fibers, and synthetic plastic spun or filament fibers, and mixtures of any of the foregoing. Fire retardant materials such as antimony oxide or triphenyl antimony may be incorporated in the material to increase its fire resistance. A preferred material is a glass fiber laminate which has been impregnated with an uncured, or partially cured, thermosetting bonding agent such as a phenolic resin. In forming the shell 14, a sheet or batt of phenolic resin impregnated glass fibers, for example, is compressed between the heated platens of a suitably dimensioned press mold. Sufficient heat and pressure are applied to the batt to form it into a self-supporting, rigid structure. By way of illustration, a typical shell, such as the shell 14, will comprise a central area 16 formed of phenolic resin bonded glass fibers having a density in the range of about 2 to about 5, preferably about 3 to about 4, pounds per cubic foot, and a thickness of the order of about $\frac{1}{4}$ to about $\frac{3}{4}$, preferably about $\frac{1}{3}$ to about $\frac{1}{2}$ inch. The edges of the shell advantageously should have a density in the range of about 5 to about 24, preferably about 8 to about 12 pounds per cubic foot, and a thickness of about 1/16 to about $\frac{1}{4}$, preferably about $\frac{1}{8}$ inch. The temperature of the heated platens used to form the shell can range from about 350° F. to about 450° F., usually from about 375° F. to about 400° F. The pressures employed generally will be of the order of about 250 to about 500 pounds per square inch. The amount of pressure applied to the batt or layer of acoustical material to form the shell 14 will be greater along the edges than in the central area of the batt or layer to obtain the desired edge density and thickness.

As illustrated, the shell 14 is provided with a decorative surface or facing 20. The facing 20 may be formed of open-weave natural or synthetic fabrics, or combinations thereof, or the exposed surface of the shell may be coated with a suitable latex-based paint. Preferred facing materials are woven spun or filament plastics such as vinyls and polyesters, and glass fibers. The weave of the facing should be such as to permit sound energy to easily pass through it while at the same time having the appearance of a solid, non-porous surface. An especially preferred material is a glass fiber, textured fabric having a nubby, or roughened surface. Such a facing material acts to augment the sound absorption and light reflectance properties of an acoustical panel, while imparting an attractive and interesting surface treatment to the panel. The thickness of the facing material may range from about 2 to about 8 mils, but preferably is about 4 to 5 mils.

The inner surface 16*a* of the central area 16 of the preformed shell 14 is essentially parallel to the inner surface 18*c* of the outwardly extending section 18*b* of the edges 18, but lies in a plane which intersects the section 18*a* of the edge 18 thus forming a recess 22 in the shell 14 for receiving a pre-cut sheet or batt or an acoustical material having a preselected density and thickness. As shown in FIG. 3, the batt 24 of acoustical material is positioned on the inner surface 16*a* of the central area 16 of the shell 14, and the outer margins 24*a* of the batt 24 overlie the inner surface 18*c* of the outwardly extending section 18*b* of the edges 18. In the embodiment of the panel 12 shown in FIG. 4, the precut sheet or batt 26 is sized to overlie the inner surface 16*a* only of the central area 16 of the shell 14, and the outer margin 26*a* of the batt 26 partly abuts the inner surface 18*d* of the section 18*a* of the edges 18 of the shell. While the section 18*b* of each of the edges 18, as formed in accordance with the practice of this invention, has sufficient rigidity and structural strength to support a finished panel on any grid system, the embodiment of the panel construction shown in FIG. 3 is preferred for larger size panels to provide added structural strength and dimensional stability to prevent sagging or warping of the panel.

The density and thickness of the acoustical material used in forming the batts 24 and 26 may be selectively varied to meet the performance demands of substantially any environment in which the finished panels are to be installed. The generally optimum objectives of the invention are attained with batts having a density of the range of about 2 to about 4, preferably from about 2.5 to about 3, pounds per cubic foot. The thickness of the batts can vary from about $\frac{5}{8}$ inch to about 2.5 inches, usually from about 1 to about 1.5 inches. Again, as stated, the density and thickness of the layers will be predetermined by the requirements of the room or other enclosure, in which the finished panel is to be installed. The batts 24 and 26 may be formed of the same acoustical material employed to fabricate the preformed shell 14. The practice of the invention, of course, enables the use of a wide variety of fibers, both natural and synthetic, and mixtures thereof, The batts advantageously are secured to the shell 14 by means of a suitable adhesive. Where the batts comprise glass fibers impregnated with a thermosetting bonding agent such as a phenolic resin, the batts can be bonded to the shell 14 by applying pressure and heat to the batt and the shell by means of heated platens of a compression mold.

The all around performance of the panel construction of this invention is optimized by providing a backing sheet or layer 30 on the exposed surface of the batts 24 and 26. In accordance with a preferred practice of the invention, the backing sheet 30 comprises a metallic film, especially a metal foil fabricated of a lightweight metal such as aluminum having a thickness in the range of about 0.7 to about 2, preferably about 1 mil. A glass felt sheet of similar dimensions can be used in lieu of the foil, if desired. The sheet 30 may be bonded to the batts 24 or 26 by a suitable binder such as a hot melt adhesive or a phenolic resin. The backing sheet 30 can be applied to the batts 24 or 26 under pressure and heat either before, or at the time the batts are being bonded to the shell 14. As disclosed in U.S. Pat. No. 3,183,996, the metallic backing sheet 30 acts to reflect sound energy back into the batts 24 and 26 where it is absorbed. The backing sheet also prevents sound energy from above the panel from entering the panel, and thus insulates the area below the panel from extraneous sounds. The backing sheet further acts to eliminate "masking noise hot spots" thereby enabling the reduction of the number of speakers required in generating the "pink noise" above the finished panel in an open-plan office. This feature represents a significant cost savings in the construction of such offices. The backing sheet additionally reduces "breathing" through the panel, a condition which occurs when the area above the installed panel is cooler than the area below whereby air from the area below the panel would tend to be drawn upwardly through the panel from the facing toward the back of the panel. In addition to heat loss in the area below the panel this would tend to cause dirt to cling to the facing of the panel. The backing sheet effectively prevents such air passage through the panel. The backing sheet also provides an effective thermal insulation barrier for the panel.

Figure 5:
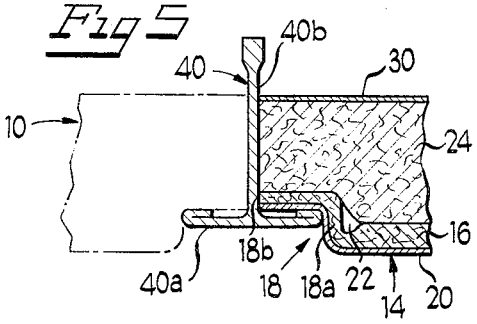
FIG. 5 is a fragmentary sectional view showing an embodiment of the panel construction supported on a "T" rail grid or suspension system.
Figure 6:
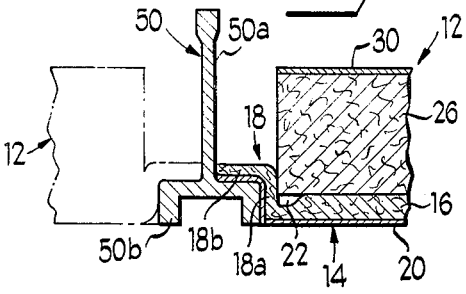
FIG. 6 is a fragmentary sectional view showing another embodiment of the panel construction mounted on another form of a grid or suspension system.

In FIGS. 5 and 6 of the drawing, the embodiments 10 and 12 of the panel construction are shown supported on typical grid systems. The installation shown in FIG. 5 is referred as a standard reveal installation in which the panel 10 is edge supported on the transverse portion 40*a* of a "T" rail 40. The vertical portion 40*b* of the rail 40 is supported from the ceiling of a room. The grid system shown in FIG. 6 on which the panel 12 is edge supported is referred to as a flush reveal installation, and comprises a rail 50 having a vertical portion 50*a* which is supported from above, and a U-shaped transverse portion 50*b* on which the panel 12 is engaged. The multi-density panel construction of this invention enables the formation of a panel which fits exactly to the configuration of the grid system on which it is mounted. The close fitting arrangement between the panel and the elements of the grid system on which the panel is mounted eliminates the double-line effect usually seen with conventional panel installations, and which is highly objectionable to architects. In addition, the close fit achieved between the panel construction and the grid system substantially prevents any passage of sound energy in either direction between the edges of the panel and the supporting grid system.

Figure 1:
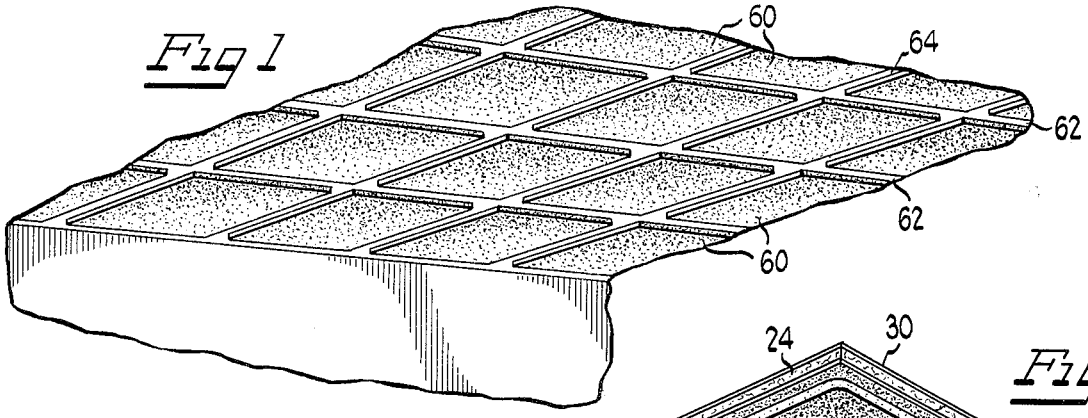
FIG. 1 is a perspective, fragmentary view showing a ceiling installation utilizing the panel construction of the present invention.
Figure 2:
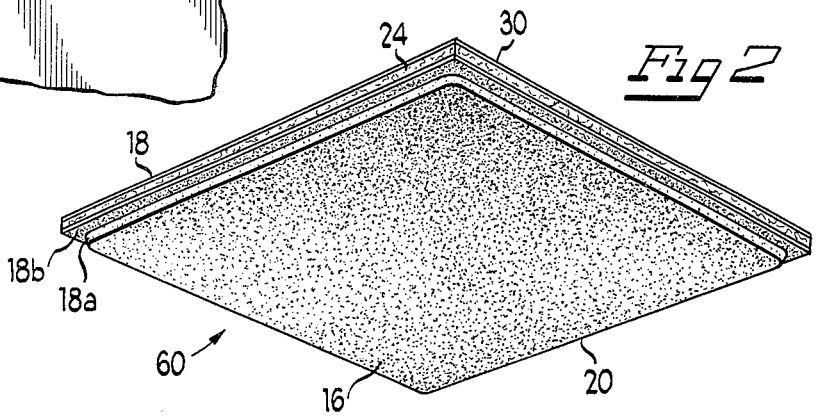
FIG. 2 is a perspective view of an embodiment of the panel construction of the present invention.

In FIG. 1, a plurality of panels 60 constructed in accordance with the teachings of this invention are illustrated as supported on a grid system comprised of "T" shaped rails 62 and cross rails 64. The rails 62 and 64 are of the type shown in FIG. 5 of the drawing, with the vertical portion thereof being supported from above the installation. The panels 60, which are constructed like the panel 10 of FIG. 3, are edge supported on the transverse portion of the rails, and can be readily positioned on and removed from the grid system by tilting them in a known manner so as to clear the rails. FIG. 2 illustrates one of the panels 50, comprising the installation of FIG. 1.

Figure 7:
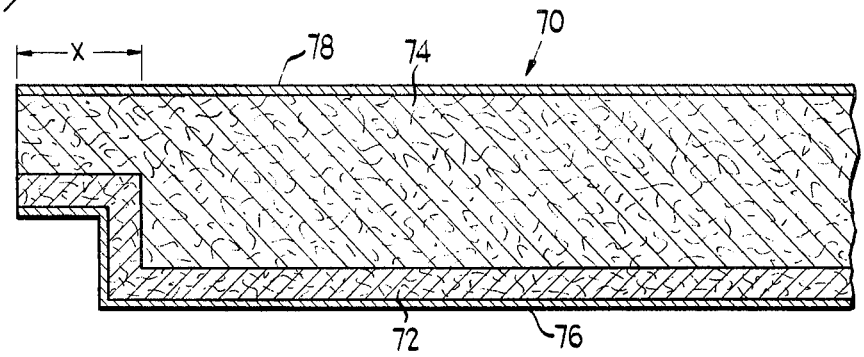
FIG. 7 is an enlarged fragmentary sectional view of yet another embodiment of the panel construction of this invention showing a body portion of substantially uniform density and thickness.

The embodiment of the panel construction shown in FIG. 7, and designated generally by reference numeral 70, like the panels 10 and 12 described hereinabove, comprises a preformed body portion or shell 72. Unlike the shells comprising the panels 10 and 12, the shell 72 of the panel 70 is substantially uniform in thickness and density. The shell 72 is adapted to receive a sheet or batt 74 of acoustical material, and is provided with a decorative surface or facing 76. A backing sheet or layer 78 is bonded to the batt 74. The panel construction 70 is referred to in the trade as a "bold reveal" type panel. The thickness and density of the shell 72 and the batt 74 may be varied as desired to provide a panel capable of meeting the acoustical performance requirements of the environment in which it is to be installed. The thickness and density of the edges, as delineated by the letter "x", of the panel 70 can be varied in width and density to impart the desired rigidity to the panel thereby enabling the panel to be fabricated in any desired size. Generally speaking and by way of illustration, for most installations, the density of the material comprising the shell 72 will range from about 6 to about 20 pounds per cubic foot, while the density of the batt 74 will vary from about 2 to about 4 pounds per cubic foot.

Figure 8:
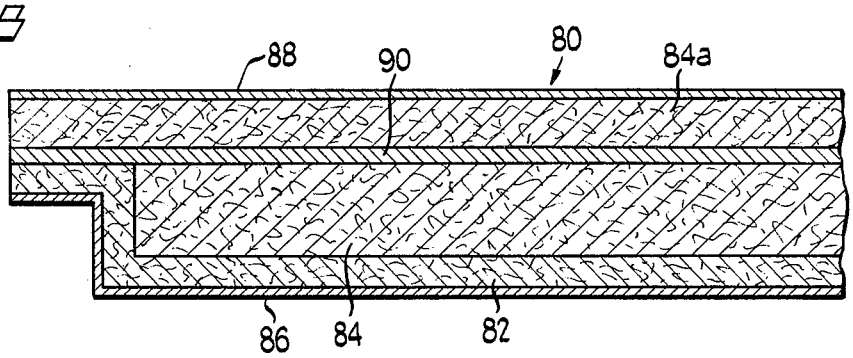
FIG. 8 is a fragmentary, enlarged sectional view of an embodiment of the invention incorporating a septum.

The embodiment of the panel construction of this invention illustrated in FIG. 8, and designated generally by reference numeral 80, comprises a preformed shell 82, a batt 84 of acoustical material, a decorative facing 86 and a backing sheet 88 which may be a metal foil. The panel 80 differs from the previously described panels in that it incorporates an additional layer or septum 90. While only a single layer or septum is shown, additional layers or septa may be incorporated in a panel construction to achieve a desired result. The septum, or septa, as the case may be, serves to enhance and augment the sound transmission characteristic (STC) of a panel, as well as a means for providing an effective barrier to the passage of dirt laden air through the panel. The septum may be formed of a metal foil such as aluminum foil or lead foil, or it may be fabricated of a synthetic plastic film such as vinyls and polyesters. Fiber glass or glass felt sheets may also be used, as can sheets of a high density mineral fiber. The thickness of the septum can range from 1 to 7 or 8 mils, more or less, depending upon the performance demands required of a panel and advantageously will have dimensions conforming to the length and width of the panel in which it is incorporated. As shown in FIG. 8, the batt 84 is formed in two sections 84*a* and 84*b* to accommodate the septum 90. The septum 90 advantageously is adhered to the sections 84*a* and 84*b* by means of a suitable adhesive material such as a thermosetting phenolic resin.

Figure 9:
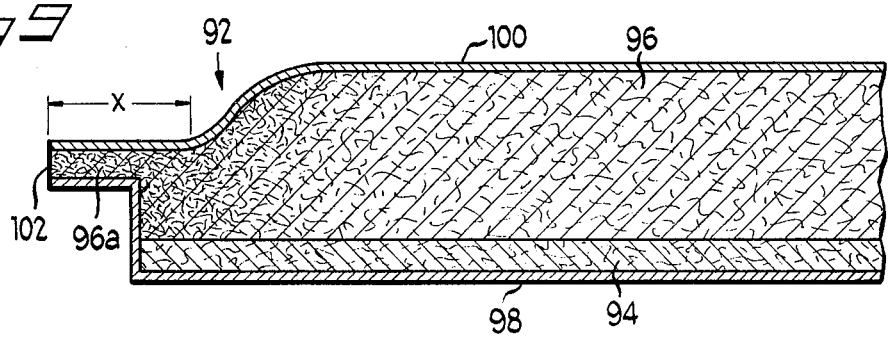
FIG. 9 is an enlarged fragmentary sectional view of another embodiment of the panel construction.

The panel constructions shown in FIG. 9 of the drawings is referred to in the trade as a "flush reveal" type panel. The panel, designated generally by reference numeral 92, comprises a preformed shell 94 having a preselected thickness and density, and a layer or batt 96 of an acoustical material also having a predetermined thickness and density. As in the previously described embodiments of the invention, a decorative facing 98 and a backing layer 100 are provided for the panel 92. The density of the batt 96 along the edges of the panel and the width of the edges, as represented by the letter "x", can be varied to impart the desired rigidity to the panel. To this end, the outer edges 96*a* of the batt 96 ay be subjected to higher pressures than the main body of the batt to achieve greater densification of the acoustical material. Generally speaking, in a panel such as the panel 92, the density of the material forming the shell 94 will be of the order of about 4 to about 14 pounds per cubic foot, while the density of the edges 96*a* of the batt may range from about 6 to about 20 pounds per cubic foot. If desired, the exposed surface of the edges 96*a* can be provided with a coating 102 of a sealer, or the margins of the backing layer 100 can be wrapped over the edges 96*a* to form a completely enclosed panel for special installations such as clean rooms. Exemplary of sealants which can be employed to form the coating 102 are rubber latex adhesives, phenolic resins, neoprene cements, and polysulfide based sealants, to name a few.

Figure 10:
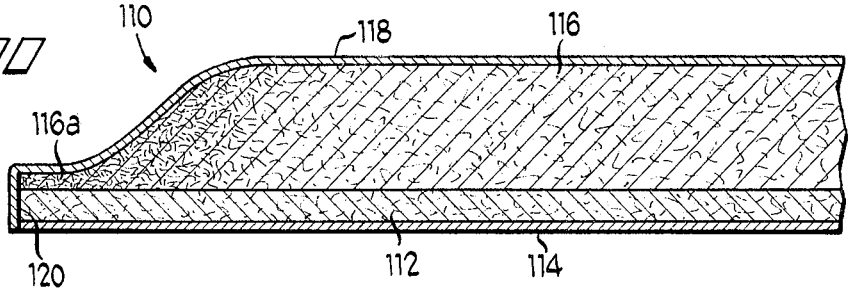
FIG. 10 is an enlarged fragmentary sectional view of an embodiment of the panel construction showing the edges of the panel sealed.

The panel construction illustrated in FIG. 10, and designated generally by reference numeral 110, is a construction having special utility as a "computer room" panel. The panel 110 comprises a preformed shell 112 formed of an acoustical material and having a density of the order of from about 4 to about 14 pounds per cubic foot. A fabric or decorative film facing 114 is provided for the shell 112. A layer or batt 116 is adhered to the shell 112, and a backing layer 118, which may be a metal foil, is secured on the outer surface of the batt 116. As in the case of the panel 92 shown in FIG. 9, the edges 116*a* of the batt 116 advantageously have a greater density than the main body of the batt to impart the required rigidity to the panel. Thus, by way of illustration, the edges 116*a* may have a density ranging from about 6 to about 20 pounds per cubic foot, while the main body of the batt may have a density of the order of about 2 to about 4 pounds per cubic foot. The exposed edges of the panel 110 desirably are provided with a coating 120 of a sealant, and then wrapped with the backing material, as shown, to completely enclose the panel. This edge treatment, in cooperation with the facing 114, serves to prevent dust and loose fibers from above from entering the environment in which the panel is installed.

As indicated hereinabove, panels constructed in accordance with the practice of this invention have sound absorption properties which exceed those of conventional acoustical panels. Thus, in tests performed with acoustical panels of the present invention, noise reduction coefficients ranging upwards to 1.05 have been attained as compared to coefficients of 0.50 to 0.95 for high quality acoustical panels presently being used. These tests were based on conditions as set forth by the American Society for Testing Materials for Sound Absorption of Acoustical Materials in Reverberation Rooms under designation C42358T.

While for purposes of illustration representative embodiments of the invention have been shown and described, other embodiments of the invention may become apparent to those skilled in the art upon reference to this disclosure and, accordingly, the scope of the invention is to be determined by the appended claims.

What is claimed is:

1. An acoustical panel construction adapted to be edge supported as a unit on a grid system, comprising: a preformed body portion which defines the exposed surface area of the panel, said body portion being formed of an acoustical material having a preselected density and thickness and having a facing material on the outer surface thereof for enhancing the rigidity, dimensional stability and structural strength of the body portion, a layer of an acoustical material having a preselected density and thickness carried on the body portion, the density and thickness of said layer being such as to enable it to be carried on the body portion without causing the body portion to sag or warp and to provide in cooperation with the acoustical material of the body portion sufficient sound absorption capabilities to the panel to meet the predetermined acoustical demands of substantially any room in which the panel is installed, and distinctly defined edge portions integrally joined to the margins of the panel, said edge portions extending laterally outwardly along the margins of the panel and being defined by the side margins of the body portion and said layer of acoustical material, said side margins, having a preselected density and thickness such that when the edge portions are positioned on the horizontal panel supporting surface of a rail, or the like, of a grid system they will by themselves have sufficient structural strength to support the panel as a unit on a grid system without sagging or warping of the panel.

2. An acoustical panel construction according to claim 1 wherein barrier means is incorporated in the layer of acoustical material carried on the body portion, said barrier means acting to improve the sound transmission characteristic of the panel construction and to substantially prevent the passage of dirt-ladened air through the panel.

3. An acoustical panel construction according to claim 2 wherein the barrier means comprises a septum formed of a sheet material positioned along the layer of acoustical material carried on the body portion.

4. An acoustical panel construction according to claim 1 wherein the edges of the side margins of the body portion and the layer of acoustical material are provided with a coating of a sealant to prevent the passage of airborne contaminants therethrough.

5. A panel construction according to claim 1 wherein the layer of acoustical material carried on the body portion is adhered to the inner surface of the body portion.

6. A panel construction according to claim 1 wherein the layer of acoustical material carried on the body portion has a density ranging from about 2 to about 4 pounds per cubic foot and a thickness of the order of about $\frac{5}{8}$ to about 2.5 inches.

7. A panel construction according to claim 6 wherein the acoustical material employed to form the body portion comprises a batt formed of glass fibers.

8. A panel construction according to claim 1 wherein the layer of acoustical material carried on the body portion comprises a pre-cut batt having a backing material adhered to the outer major surface thereof.

9. A panel construction according to claim 8 wherein the backing material comprises a thin metal foil.

10. A panel construction according to claim 1 wherein the facing material has a roughened, nubby outer surface which is light reflecting and has sound dissipating properties.

11. A panel construction according to claim 10 wherein the side margins of the backing material overlie and are adhered to the edge portions of the panel to completely enclose the acoustical material of the body portion and said layer of acoustical material carried on the body portion.

12. An acoustical panel construction according to claim 1 having a noise reduction coefficient in excess of 0.95.

13. An acoustical panel construction according to claim 1 wherein the dimensions of the panel are of the order of 2′×2′ to 5′×5′.

* * * * *